US006418895B1

(12) United States Patent
Miyasaka et al.

(10) Patent No.: US 6,418,895 B1
(45) Date of Patent: Jul. 16, 2002

(54) VARIABLE VALVE OPEN-AND-CLOSURE TIMING CHANGING APPARATUS FOR INTERNAL COMBUSTION ENGINE

(75) Inventors: Hideyuki Miyasaka; Yoshinori Ichinosawa, both of Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/668,385

(22) Filed: Sep. 25, 2000

(30) Foreign Application Priority Data

Oct. 14, 1999 (JP) ..... 11-292184

(51) Int. Cl.[7] ..... F01L 1/34
(52) U.S. Cl. ..... 123/90.17
(58) Field of Search ..... 123/90.15, 90.17, 123/90.31

(56) References Cited

U.S. PATENT DOCUMENTS

| | | | | |
|---|---|---|---|---|
| 5,797,361 A | * | 8/1998 | Mikame et al. | 123/90.17 |
| 5,813,378 A | * | 9/1998 | Sato | 123/90.17 |
| 6,024,062 A | * | 2/2000 | Kako et al. | 123/90.17 |
| 6,129,062 A | | 10/2000 | Koda | 123/90.17 |
| 6,186,104 B1 | * | 2/2001 | Torii et al. | 123/90.17 |
| 6,314,929 B1 | | 11/2001 | Maeyama et al. | 123/90.17 |
| 6,318,319 B1 | | 11/2001 | Miyasaka et al. | |
| 6,328,008 B1 | | 12/2001 | Io | 123/90.17 |

FOREIGN PATENT DOCUMENTS

| | | |
|---|---|---|
| DE | 100 45 418 A1 | 4/2001 |
| JP | 10-141024 | 5/1998 |

* cited by examiner

*Primary Examiner*—Wellun Lo
(74) *Attorney, Agent, or Firm*—Foley & Lardner

(57) ABSTRACT

In a valve open-and-closure timing changing apparatus for an internal combustion engine, a rotary body (3) is revolved in synchronization with a revolution of the engine, a camshaft (1) is provided, and a valve open-and-closure changing mechanism is interposed between the rotary body and the camshaft to relatively rotate the camshaft to the rotary body to enable a change in a valve open-and-closure timing of at least one of intake and exhaust valves. The valve open-and-closure mechanism includes: a housing member (4) to be revolved together with the rotary body; a vane rotor relatively rotatably housed within the housing member, to be revolved together with the camshaft, and having at least one vane radially projected therefrom; at least one pair of advance angle and retardation angle chambers partitioned between the housing member and vane rotor by means of the vane; a hydraulic supply-and-draining device that supplies a working oil into either one of the pair of the advance angle or retardation angle chamber while draining the working oil from the other of the pair of the chambers to achieve a relative rotation between the housing member and vane rotor; and a boss portion projected from one axial direction of the vane rotor toward an outside of the housing member or extended at the same position thereof.

14 Claims, 3 Drawing Sheets

VARIABLE VALVE OPEN-AND-CLOSURE TIMING CHANGING APPARATUS FOR INTERNAL COMBUSTION ENGINE

BACKGROUND OF THE INVENTION

1. Field of the Invention

The present invention relates to a variable valve open-and-closure timing changing apparatus to change an open-and-closure timing of either an intake valve or an exhaust valve during a driving of an internal combustion engine.

2. Description of the Related Art

Such a kind of variable valve open-and-closure timing changing apparatus described above indicates a rotary body which is drivingly revolved by means of a crankshaft and a changing mechanism, interposed between a camshaft to drive the intake valve or exhaust valve, to relatively revolve the camshaft to the rotary body so as to modify the open-and-closure timing of either the intake valve or exhaust valve.

A Japanese Patent Application First Publication No. Heisei 10-141024 published on May 26, 1998 exemplifies a previously proposed valve open-and-closure timing changing apparatus.

The previously proposed valve open-and-closure timing changing apparatus includes: a housing which is revolved together with a rotary body revolved by means of the crankshaft of the engine; a rotor which revolves together with the camshaft; a plurality of vanes projected radially from the rotor and to form a plurality of working. oil chambers within the housing; and oil pressure supply and draining device to supply and drain working oil into each of the working oil chambers so that the housing is relatively revolved to the rotor.

An axial inner side of the rotary rather than an end surface of the housing is attached onto the end surface of the camshaft and the housing is journaled to the camshaft.

SUMMARY OF THE INVENTION

Since, in the previously proposed valve open-and-closure timing changing apparatus, the rotor is attached at its axial inner side than the end surface of the housing onto the camshaft, it is necessary to attach the rotor onto the camshaft with an accuracy of a gap of a journal between the housing and the camshaft taken into consideration when the previously proposed valve open-and-closure timing changing apparatus is actually mounted onto the normally available internal combustion engine. It may, thus, be difficult to attach the rotor onto the camshaft.

In addition, since it is necessary to make an accommodation design to the attachment of the housing to the camshaft due to an axial extension of the end of the camshaft to journal the housing, it is difficult to attach the previously proposed valve open-and-closure timing changing apparatus to the normally available internal combustion engine.

It is, therefore, an object of the present invention to provide a variable valve open-and-closure timing changing apparatus which is designed to enable the whole apparatus to be easily attached to a normally available internal combustion engine.

The above-described object can be achieved by providing a valve open-and-closure timing changing apparatus for an internal combustion engine, comprising: a rotary body to be is revolved in synchronization with a revolution of the engine; a camshaft; a vane rotor relatively rotatably housed within the housing member, to be revolved together with the camshaft, and having at least one vane radially projected therefrom; at least one pair of advance angle and retardation angle chambers partitioned between the housing member and vane rotor by means of the vane; a hydraulic supply-and-draining device that supplies a working oil into either one of the pair of the advance angle chamber or retardation angle chamber while draining the working oil from the other of the pair of the chambers to achieve a relative rotation between the housing member and vane rotor; and a boss portion projected from one axial direction of the vane rotor toward an outside of the housing member or extended at the same position thereof.

The above-described object can also be achieved by providing a valve open-and-closure timing apparatus for an internal combustion engine, comprising: a rotary body to be is revolved in synchronization with a revolution of the engine; a camshaft; a housing member to be revolved together with the rotary body; a vane rotor relatively rotatably housed within the housing member, to be revolved together with the camshaft, and having at least one vane radially projected therefrom; at least one pair of advance angle and retardation angle chambers partitioned between the housing member and vane rotor by means of the vane; a hydraulic supply-and-draining device that supplies a working oil into either one of the pair of the advance angle or retardation angle chamber while draining the working oil from the other of the pair of the chambers to achieve. a relative rotation between the housing member and vane rotor; a boss portion projected from one axial direction of the vane rotor toward an outside of the housing member or extended at the same position thereof; and a lock mechanism including: a slide motion enabling hole disposed in the vane; a slide member to make a slide motion thereof within the slide motion enabling hole; a fit hole disposed in the housing member to which the slide member is enabled to be fitted; a biasing member to bias the slide member in a direction toward the fit hole; and a hydraulic passage to make the slide motion of the slide member in accordance with a hydraulic.

DETAILED DESCRIPTION OF THE PREFERRED EMBODIMENT

Reference will hereinafter be made to the drawings in order to facilitate a better understanding of the present invention.

Figure 1:
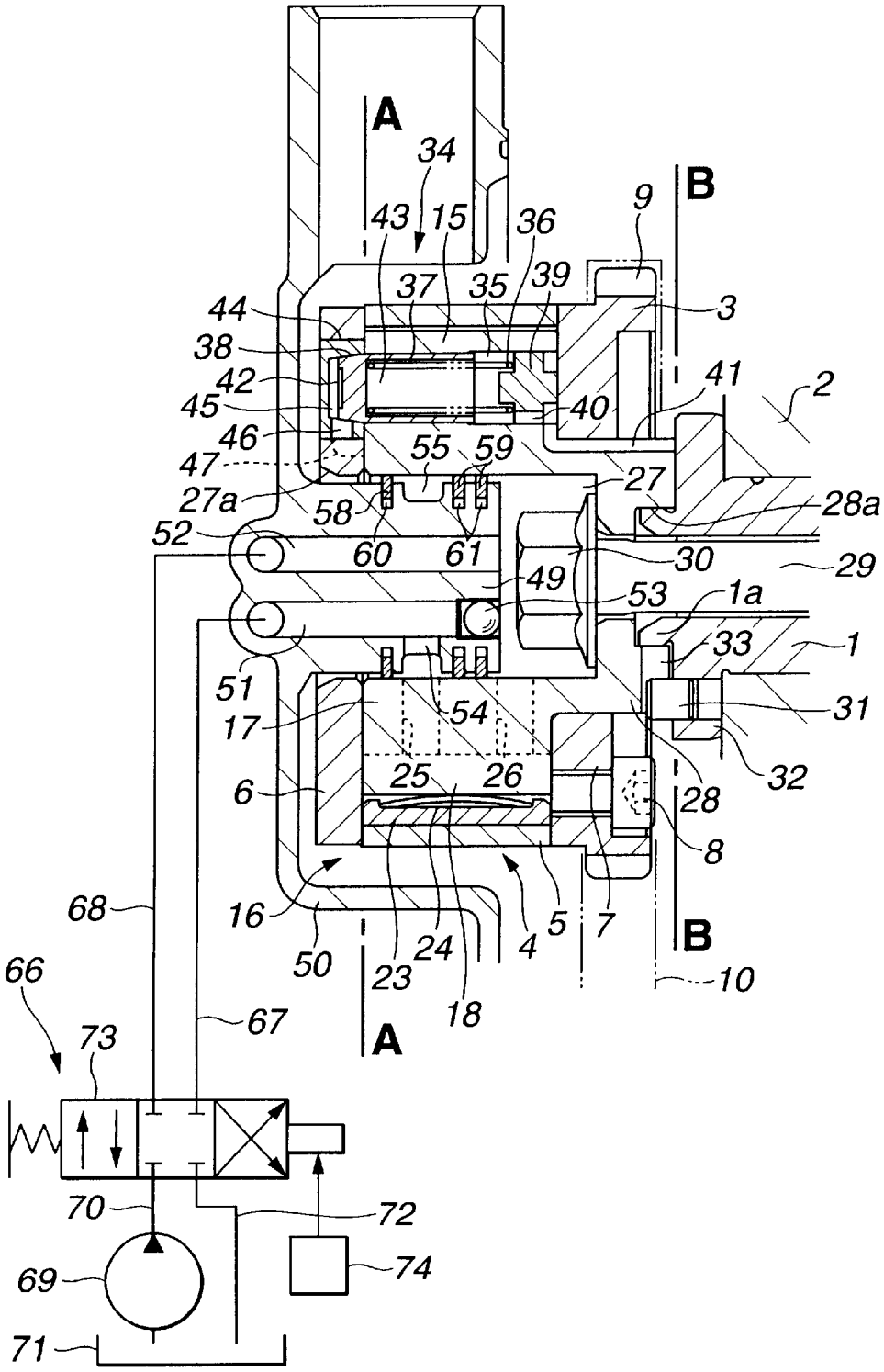
FIG. 1 is a cross sectional view of a variable valve open-and-closure timing changing apparatus for an internal combustion engine in a preferred embodiment according to the present invention.

FIG. 1 shows a cross sectional view of an essential part of a variable valve open-and-closure timing changing apparatus for an internal combustion engine in a preferred embodiment according to the present invention.

Figure 2:
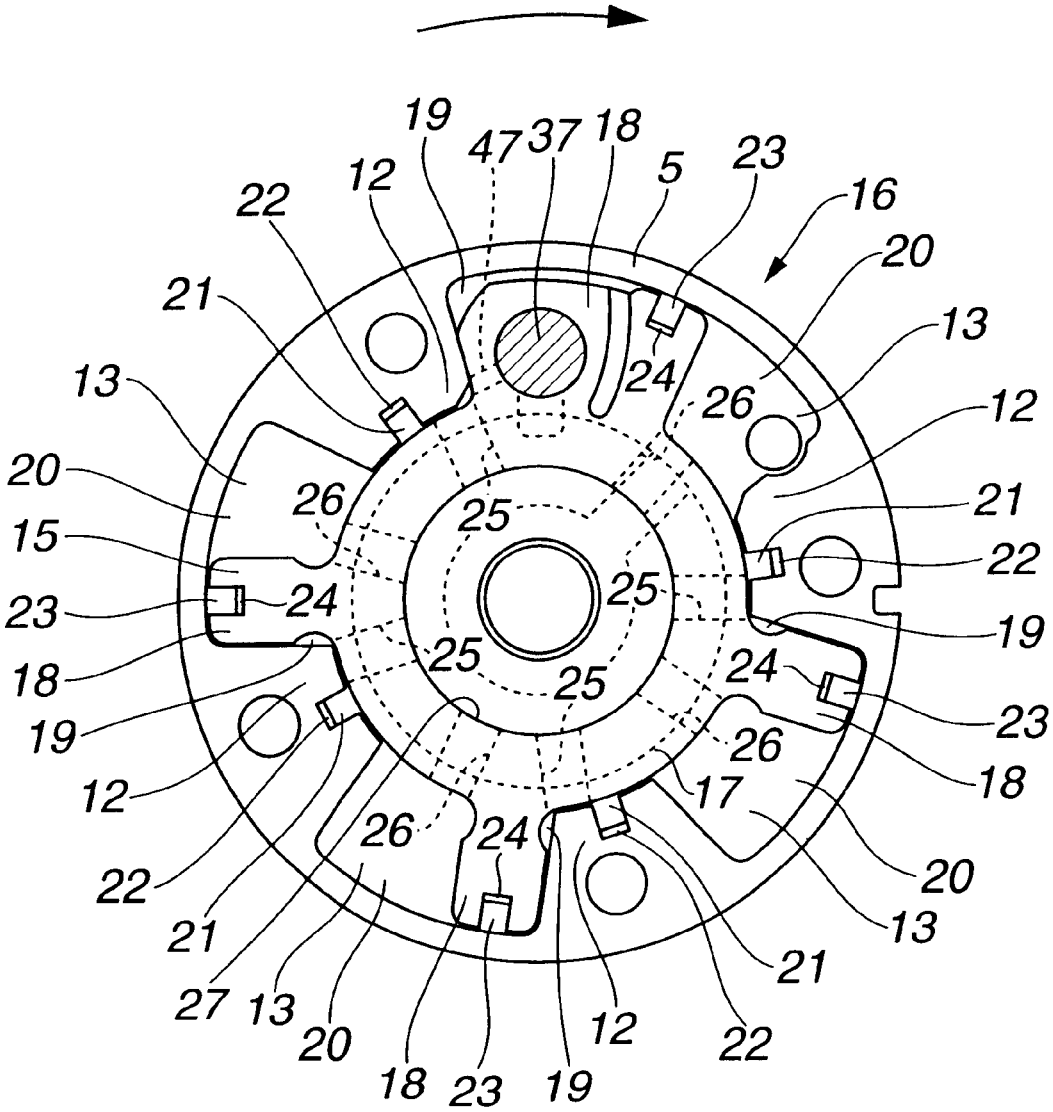
FIG. 2 is a cross sectional view cut away along a line of A—A in FIG. 1 with an axial member, bolts, and a sprocket removed

FIG. 2 is a cross sectional view of the variable valve open-and-closure timing changing apparatus cut away along a line A—A in FIG. 1 with an axial member, bolts, and a sprocket removed.

Figure 3:
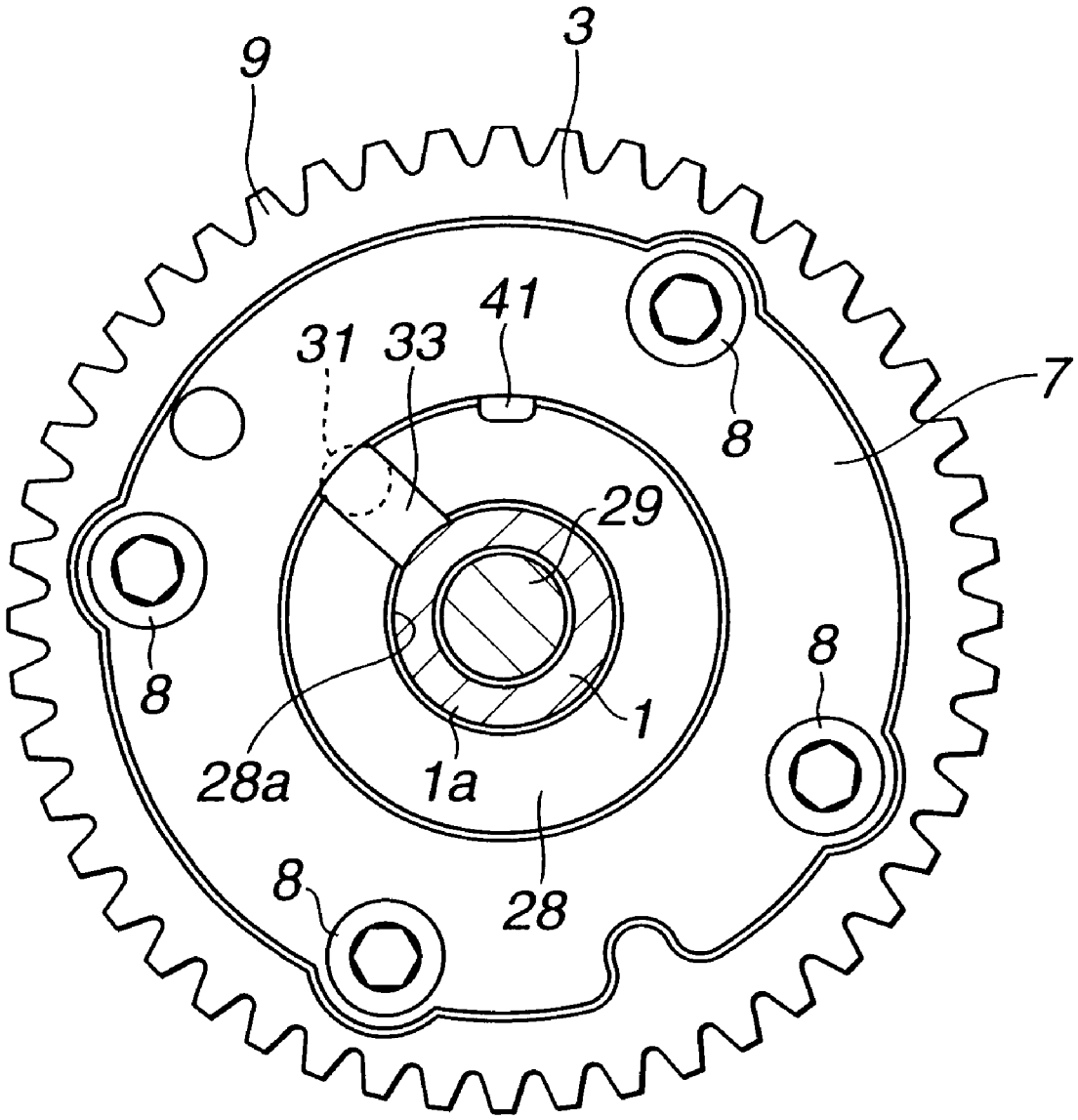
FIG. 3 is a cross sectional view cut away along a line of B—B in FIG. 1.

FIG. 3 is a cross sectional view of the variable valve open-and-closure timing changing apparatus cut away along a line B—B in FIG. 1.

A camshaft denoted by 1 enables either an intake valve or an exhaust valve of the engine to be driven in FIG. 1. In this embodiment, the camshaft 1 drives the intake valve.

The camshaft 1 is rotationally supported by means of a journal 2 fixed onto a cylinder head (not shown).

A cam profile is formed at a right end (not shown of a stem portion of the camshaft 1 as viewed from FIG. 1. The cam profile causes the intake valve to be driven to be opened or to be closed.

The camshaft 1 is rotatably driven by means of a rotary body 3 rotated in synchronization with the engine.

In the embodiment, the rotary body 3 is a sprocket which is driven to be revolved by means of a crankshaft (not shown) of the internal combustion engine.

It is noted that the sprocket 3 is rotatable together with a housing member 4. In addition, the sprocket 3 is enabled to make a relative pivotal motion to the camshaft 1 through a predetermined angle.

The sprocket 3 is integrally formed with a housing member 4 at an outer peripheral of a plate member 7 of a housing member 4. The housing member 4 is constituted by an annular housing main body 5 and a pair of plate members 6 and 7 sealing both ends of the housing 8 integrally links the housing main body 5 to the pair of plate members 6 and 7. Outer teeth 9 are formed on the outer periphery of the sprocket 3. A timing chain 10 is wound on the outer teeth 9 so as to be driven by means of a crankshaft (not shown).

As shown in FIG. 2, a plurality of projections 12. are formed on the housing member 4 which are projected toward radially an inner direction of the annular housing main body 5. An inner part of the housing member 4 is wholly hollow. Consequently, four chambers 13 are formed in the radial direction of the plate member 6 and are linked together at a center portion of the plate member 6.

A vane member 15 is housed within the housing member 4 so as to be enabled to be relatively revolved to the housing member 4 through a predetermined angle. The vane member 15 and the housing member 14 constitute a relative revolving device 16 as will be described later.

A plurality of vanes (in the embodiment, four) 18 are projected radially from a stem portion 17 of the vane member 15, the vanes 18 being disposed within the respective chambers 13 and being housed within the housing member 4.

The vanes 18 of the vane member 15 are arranged within the respective chambers 13 so that a pair of working oil chambers are defined in both sides of circumferential directions of the vane 18 within these chambers 13. In this embodiment, four groups of the pair of working oil chambers 19 and 20 is achieved by pressurizing respective seal members 21 disposed on tip of projections 12 formed on an inner periphery of the housing main body 5 by means of each corresponding spring member 22 to slidably contact each corresponding seal member 21 on an outer periphery of the stem portion 17 of the vane member 15 and by pressurizing other seal members 23 disposed on tips of the vanes 18 through spring members 24 to slidably contact the respective other seal members 23 on the inner periphery of the housing main body 5.

A radial working oil chamber passage 25 which is communicated with one of the pair of working oil chambers 19 is formed on the vane member 15. A radial working oil chamber passage 26 which communicates with the other of the pair of working oil chambers 20 is formed on the vane member 15.

Each hole 27 in one-end open form to which each of these working oil chamber passages 25 and 26 is opened is formed in the axial direction. The working oil chamber passages 25 and 26 are opened at positions mutually separated from each other in the axial direction of the respectively corresponding holes 27.

In addition, an inner periphery of the plate member 6 disposed on an open end of the holes 27 is formed with the holes 27 together with the vane member 15. A tapered portion 27*a* whose diameter is extended in an outer direction is located on each opening end of the respective holes 27.

A journal or boss portion 28 is formed on an end of the vane member 15 which is nearer to the camshaft I with its stem portion 17 extended axially. The journal 28 has its outer periphery pivotally or pivotally journaling the plate member 7 of the housing member 4. The journal 28 is slightly projected from the end surface of the plate member 7, i.e., the end surface of the housing member 4, in the embodiment. The journal 28 may be extended over the generally the same end surface of the housing member 4.

Thus, the working oil is selectively supplied to or drained from the working oil chambers 19 and 20 via the working oil chamber passages 25 and 26 so that the housing member 4 and the vane member 15 can relatively be pivoted.

In addition, the vane member 15 is linked to the camshaft 1 via the journal 28. In details, the vane member 15 is linked to the camshaft 1 by means of a bolt 29 housed in the corresponding hole 27 and penetrated axially. through the journal 28. A head 30 of the bolt 29 is arranged on a bottom portion of the hole 27.

At this time, the camshaft 1 and the vane member 15 are concentrically matched together by fitting positioning hole 28*a* formed on the axial direction of the journal 28 of the vane member 15 into a positioning projection 1*a* formed on the camshaft 1.

Furthermore, a linkage pin 31 is formed between the journal 28 and the camshaft 1 which prevents a relative revolution of the journal 28 of the vane member 15 to the camshaft 1. In-details, the linkage pin 31 is axially extended on a radial flange 32 formed on the camshaft 1. On the other hand, a radial groove 33 is formed on the end surface of the journal 28 so that a tip of the linkage pin 31 is inserted within the groove 33. Alternatively, the groove may be provided on the camshaft 1 by extending the linkage pin on the end surface of the journal 28.

While the sprocket 3 is linked to the housing member 4, the vane member 15 linked to the camshaft 1 is relatively rotatable to the housing member 4.

The working oil is selectively supplied to or drained from the pair of working oil chambers 19 and 20 via the working oil passages 25 and 26 so that the housing member 4 can relatively by rotated within a predetermined angular range.

Hence, a relative rotating device 16 can be constituted which makes the sprocket 3 relative rotation to the camshaft 1 as main elements of the housing member 4 and the vane member 15.

A rotatable motion limiting device 34 to limit the relative rotation between the housing member 4 and the vane member 15 is installed therebetween.

In this embodiment, the rotatable motion limiting device 34 houses the plate member 36 within the cylinder hole 35 formed on the vane member 15 so that a tip of an engagement member 37 disposed on the vane member 15 so as to enable an axial projection can be engaged to an engagement hole 38 installed on the plate member 6 of the housing member 4.

The cylinder hole 35 is axially penetrated through the vane member 15, viz., one of the vanes 18 by means of which a circumferential width of the vane member 15 is widened. A spring receiver 39 for the spring member 36 is pressurized and fixed onto the opening end of the cylinder hole 35. The spring receiver 39 may be formed of a high rigidity material on the open end of the cylinder hole 35.

A cut-out groove 40 to drain an air is disposed on a predetermined position on an outer periphery of the spring receiver 39. The cut-out groove 40 is communicated between the journal 28 of the vane member 15 and the plate member 7 of the housing member 4 and, in the embodiment, is communicated with the axial groove 41 formed on the outer periphery of the journal 28. This causes an internal portion of the cylinder hole 35 positioned on a rear end of the engagement member 37 is exposed to the air via its open end and via the cut-out groove 40 and the groove 41.

A tip end of the engagement member 37 is tapered. A tip of the tapered engagement member 37 is enabled to be projected from an inner side of the cylinder hole 35. In addition, a recess 42 is formed on its tip end and a blind hole 43 which opens to the end surface of a rear end of the engagement member 37 is formed. Thus, a light weight of the above valve open-and-closure changing apparatus can be achieved.

The engagement hole 38, in this embodiment, is made of a rigid material having a rigidity higher than the plate. member 6 of the housing member 4 and is formed by burying an engagement hole member 44 on which the engagement hole 38 is formed.

The engagement hole 38 is formed on a cup shape having a large diameter opening end. The working oil chamber 45 is formed with the engagement member 37 engaged on a bottom portion of the engagement hole 38. Spaces within each of the engagement holes 38 and working oil chambers 45 are communicated to the working oil chamber 19 via the oil hole 46 formed on the engagement hole member and via the oil groove 47 formed in the plate member 6.

An axial member 49 is inserted into the hole 27 having one end opened and formed on the vane member 15. This axial member 49 is integrally formed onto a cover member 50 which encloses the whole valve open-and-closure timing changing apparatus in the preferred embodiment.

The axial member 49 is communicated with the working oil pressure passages 51 and 52 communicated with a working oil pressure supply and draining device as will be described later. The working oil pressure passage 51 is formed in an axial direction of an axial member 49 and has an open end at a bottom portion of the hole which is sealed by means of a plug member 53. The working oil pressure passage 51 is communicated with a working oil chamber passage 25 via a radial passage 54 and via a peripheral groove 55 communicated with the radial passage 54. In addition, the working oil passage 52 is formed in an axial direction of the axial member 49 and is opened toward the bottom of the hole 27 and is communicated with the working chamber passage 26 via the bottom end of the hole 27.

Seal members 58 and 59 which provide a liquid hermetic seal within the hole 27 are provided between the hole formed on the vane member 15 and the axial member 49. inserted within the hole 27. The seal member 58 is installed on the opening end of the hole exceeding a peripheral groove 55 formed on the axial member 49. A seal member 58 is housed within the seal groove 60 formed on an outer periphery of the axial member 49 and is contacted against an inner periphery of the hole 27. A seal member 59 is installed on a bottom end of the hole 27 exceeding the peripheral groove 55 formed on the axial member 49 and is contacted against an inner periphery of the hole 27. Two seal members 59 are disposed axially in the embodiment.

Thus, an inner side of the hole 27 is defined by a portion to which the working oil chamber passage 25 is opened and by a portion to which the working oil chamber passage 26 is opened.

An inner periphery of a hole 27 of the vane member 15 on which the seal members 58 and 59 are contacted is made of a high rigidity material such as an iron-series metal.

The working oil pressure supply and draining device 60 includes: supply and draining passages 67 and 68 which communicate respectively with the working oil pressure passages 51 and 52; a switching valve 73 which selectively communicate or interrupt these supply and draining passages 67 and 68 with or from an exhaust passage 72 communicated to an oil reserving tank 71; and a controller 74 to control the switching operation in the switching valve 73.

The supply and draining passages 67 and 68 are formed on the covering member 50 and, in the embodiment, is connected through an approximately right angle to the working oil pressure passages 51 and 52 formed on the axial member 49.

The switching valve 73 has a four-port valve structure in this embodiment.

It is noted that various engine driving condition indicative signals are outputted to the controller 74 to control switching operations in the switching valve 73.

In the above-described structure, when the internal combustion engine is started and the working oil is not sufficiently supplied from the oil pump 69, or a signal to maintain a most retardation angle is inputted to the control unit 74, the vane member 15 of the relative pivotal movement device 16 is placed at a most retardation angle position with respect to the housing member 4 (refer to FIG. 2). A tip of the engagement member 37 of the rotation limiting device 34 is engaged with the engagement hole 38 so that the housing member 4 is linked to the vane member 15. Therefore, the rotation driving force imposed from the crankshaft (not shown) onto the sprocket 3 via a timing chain 10 is transmitted to the camshaft 1 via the housing member 4 and the vane member 15. It is noted that, in this case, the vanes 18 of the vane member 15 are not brought in close contact with the side surface of the projections 12 within which the room 13 is formed within the housing member 4.

A rotation of the camshaft 1 causes the intake valve of the engine to be driven so as to control the valve open-and-closure operation.

In addition, when the vane member 15 is placed at the most retardation angle position with respect to the housing member, the engagement member 37 of the rotation limiting device 34 is pressurized by means of the spring member 36 so that the tip thereof is engaged to an engagement hole 38.

Thus, the relative rotation between the housing member 4 and the vane member is limited.

When the camshaft 1 causes the intake valve (not shown) to be driven, a positive or negative torque would be acted upon the camshaft 1 so that the vane member 15 is not relatively revolved to the housing member 4. Hence, such a problem that the vane 18 of the vane member 15 is impinged on the side surface of the projection 12 so that a sound is generated can be prevented.

Next, in a case where the advance angular control is carried out, a switching valve 73 of the working oil pressure supply and draining device 66 is controlled by means of the controller 74 so that a supply passage from an oil pump 69 is connected to the working oil supply and exhaust passage 70. The working oil from the oil pump 69 is introduced into the working oil chamber 19 via the hydraulic pressure passage 51, a radial passage 54, a peripheral groove 55, and a working oil pressure passage 25.

In addition, a working oil introduced within the working oil chamber 19 is introduced within the working oil chamber 19 is introduced into the working oil chamber 45 via an oil groove 47 formed on the plate member 6 and via an oil hole 46 formed on the oil groove 47 formed on the plate member 6 and the working oil hole 46 formed on an engagement hole member 44.

At the same time, the working oil chamber 20 is communicated with the exhaust passage 72 via the working oil chamber passage 26, a bottom side of the hole 27, the working oil passage pressure passage 52, and the working oil pressure supply and draining passage 68.

A working oil is introduced into the engagement hole 38 (and the working oil chamber 45) and into the working oil chamber 19 of the rotation limiting device 34. A working oil pressure of the working oil chamber 19 and the engagement hole 38(and the working oil chamber 45) is acted upon the engagement member 37 so that the engagement member 37 is biased toward the spring receiver 39 against a spring force on a spring member 36 and is pushed back within a cylinder hole 35. Therefore, an engagement is released with a tip of the engagement member disengaged from an engagement hole so that a restraint by means of the engagement member is continuously released with the housing member 4 and the vane member 15.

While the working oil is supplied within the working oil chamber 20, the working oil chamber 19 is communicated with the exhaust passage 72 so that the hydraulic (working oil chamber 20) is acted upon a side surface of the vane 18 and, thereafter, the vane member 15 is pivoted in a retardation angle direction, i.e., an anti-clock direction in FIG. 2 to the housing member 4. Hence, both sprocket 3 and the camshaft 1 are relatively rotated so that a rotational phase of the camshaft to the crankshaft is changed and the camshaft 1 is again rotated so that the valve open-and-closure timing of the intake valve driven by means of the camshaft 1 is retarded. The camshaft 1 is retardation angle controlled so that the vane member 15 is relatively revolved to the housing member 4 and reaches to the most retardation angle side. In this case, the tip of the engagement member 37 is again engaged to the engagement hole 38 by means of a spring force of the valve member 36.

With the vane member 15 pivoted in an advance angle direction or in a retardation angle direction with respect to the housing member 4, the tip of the engagement member 37 is again engaged within the engagement hole 38 by means of a spring force of the spring member 36.

In addition, with the vane member 15 pivoted in the. advance angle direction or in the retardation angle direction to the housing member 4, the switching valve 73 of the working pressure supply and draining device 66 is switched by means of the controller 74 so that the communication of the working oil pressure and exhaust passages 67 and 68 with either the supply passage 70 or the exhaust passage 72 is interrupted. At this time, both of the housing member 4 and the vane member 15 are held at a middle position in the relative rotation. The intake valve driven by means of the camshaft 1 is controlled at a desired timing.

A journal 28 to journal the housing member 4 so as to be enabled to be pivoted through a predetermined angle is installed, according to the present invention, on the end portion of the vane member 15. The vane member 15 is linked to the camshaft 1 via the journal 28. It is, therefore, not necessary to pay an attention to an accuracy in the gap of the journal 28 of the housing member 4 when the vane member 15 is attached to the camshaft 1.

Since it is not necessary to design the camshaft to accommodate with the mounting of the end of the camshaft to journal the housing member 4 by extending the end of the camshaft, it becomes easy to mount the normally available internal combustion engine.

An axial hole 27 whose one end is opened is formed on the vane member 15. The vane member 15 is linked to the camshaft 1 by means of a bolt 29 housed within the hole 27. Hence, the bolt 29 is not projected externally. A hydraulic supply and draining device 66 is arranged within the hole 27 so that a volumetric efficiency is improved and the whole system can be minimized.

The working oil chamber passages 25 and 26 which communicate with the working oil chambers 19 and 20 are. opened within the hole 27. Then, an axial member 49 on which the working oil chamber pressure passages 25 and 26 and working oil pressure passages 51 and 52 are formed which communicate with the working oil pressure supply and draining device 66 is inserted within the hole 27 can supply and drain the working oil. It is not necessary to dispose a passage for the working oil on the camshaft.

Since a linkage pin 31 to prevent the relative rotation between the journal 28 of the vane member 15 and the camshaft 1 is interposed therebetween, the relative rotation therebetween can be prevented from occurring without failure.

In addition, since the linkage pin 31 is planted into the flange 32 of the camshaft 1 and a groove 33 into which the linkage pin 31 is inserted on the end surface of the journal 28 of the vane member 15 is formed in the radial direction, it is not necessary to pay a special attention to a positional accuracy in the radial direction for the linkage pin. The linkage pin may be installed with the positional accuracy in a peripheral direction taken into consideration. A rotation stop may be installed with a good accuracy.

In addition, since the groove 41 by which the working oil can be communicated is formed between the journal 28 of the vane member 15 and the plate member 7 of the housing member 4, the working oil can be used to lubricate a journal slide motion.

That is to say, a slight clearance is present between the vane member 15 and the housing member 4 to make the relative rotational movement between the vane member 15 and the housing member 4.

Since the working oil within the working oil chamber 19 and 20 is linked within the groove 41, the working oil. from the groove 41 is supplied to a slide surface and lubricated.

The entire contents of Japanese Patent Application No. Heisei 11-292184 filed in Japan on Oct. 14, 1999 are herein incorporated by reference. Although the invention has been described above by reference to certain embodiment of the invention, the invention is not limited to the embodiments described above.

For example, although the seal members 58 and 59 are housed within the seal grooves 61 and 62 formed on an outer periphery of the axial member 49, the seal members 58 and 59 may be housed within the seal grooves formed on an inner periphery of the hole 27 of the vane member 15. In this alternative case, the axial member 49 may be formed of a high rigidity material. Although, in the valve open-and-closure timing changing apparatus in the embodiment described above, the valve open-and-closure timing is controlled in the advance angle control mode, the present invention is applicable to the valve open-and-closure timing is controlled in a retardation angle control mode.

Modifications and variations of the embodiments described above will occur to those skilled in the art in the light of the above teachings. The scope of the invention is defined with reference to the following claims.

What is claimed is:

1. A valve open-and-closure timing changing apparatus for an internal combustion engine, comprising:

a rotary body adapted to revolve in synchronization with a revolution of a crankshaft connected to the engine;

a camshaft;

a housing member that revolves together with the rotary body;

a vane rotor member relatively rotatably housed within the housing member, that revolves together with the camshaft, and having at least one vane radially projected therefrom;

at least one pair of advance angle and retardation angle chambers partitioned between the housing member and vane rotor member by the vane;

a hydraulic supply-and-draining device that supplies working oil into either one of the pair of the advance angle or retardation angle chamber while draining the working oil from the other of the pair of the chambers to achieve a relative rotation between the housing member and vane rotor member;

a boss portion projected from one axial direction of the vane rotor toward an outside of the housing member or extended at same position thereof;

a linkage pin interposed between a journal of the vane rotor member and the camshaft to prevent a relative rotation between the journal of the vane rotor member and the camshaft, the linkage pin being planted into either one of the journal of the vane rotor member or the camshaft; and a groove into which the linkage pin is inserted formed radially on the other of the journal of the vane rotor member or the camshaft.

2. A valve open-and-closure timing apparatus for an internal combustion engine as claimed in claim 1, wherein an axial hole is formed on the vane rotor member whose one end is opened and a bolt housed in the axial hole causes the vane rotor member to be linked to the camshaft.

3. A valve open-and-closure timing apparatus for an internal combustion engine as claimed in claim 2, wherein an axial member to open working oil chamber passages communicated with the respective working oil chambers and on which hydraulic pressure passages to communicate with the working oil passages and the hydraulic pressure supply and draining device are formed is inserted into the axial hole.

4. A valve open-and-closure timing apparatus for an internal combustion engine as claimed in claim 1, wherein a flange is formed on the camshaft.

5. A valve open-and-closure timing apparatus for an internal combustion engine as claimed in claim 4, wherein a second journal is disposed on a tip end of the flange and is housed within a journal hole to house the second journal therein.

6. A valve open-and-closure timing apparatus for an internal combustion engine as claimed in claim 1, wherein the groove is formed between the journal of the vane rotor member and a plate member of the housing member to lubricate a journal slide motion of the boss portion using the working oil in either of the advance angle chamber or retardation angle chamber flowing there through.

7. A valve open-and-closure timing apparatus for an internal combustion engine as claimed in claim 3, wherein the axial member is integrally formed with a cover enclosing the whole housing member.

8. A valve open-and-closure timing apparatus for an internal combustion engine as claimed in claim 1, wherein the boss portion serves to journal the housing member.

9. A valve open-and-closure timing apparatus for an internal combustion engine as claimed in claim 1, wherein the rotary body is a chain sprocket driven by a timing chain and is disposed on an outer periphery of a groove.

10. A valve open-and-closure timing apparatus for an internal combustion engine as claimed in claim 9, wherein the groove opens to an outside of the housing member.

11. A valve open-and-closure timing apparatus for an internal combustion engine as claimed in claim 1, wherein the vane rotor member, the vane, and the boss portion are formed as a single member.

12. A valve open-and-closure timing apparatus for an internal combustion engine, comprising:

a rotary body adapted to revolve in synchronization with a revolution of a crankshaft connected to the engine;

a camshaft;

a housing member that revolves together with the rotary body;

a vane rotor member relatively rotatably housed within the housing member, that revolves together with the camshaft, and having at least one vane radially projected therefrom;

at least one pair of advance angle and retardation angle chambers partitioned between the housing member and vane rotor member by the vane;

a hydraulic supply-and-draining device that supplies working oil into either one of the pair of the advance angle chamber or retardation angle chamber while draining the working oil from the other of the pair of the chambers to achieve a relative rotation between the housing member and vane rotor member;

a boss portion projected from one axial direction of the vane rotor member toward an outside of the housing member or extended at same position thereof;

a lock mechanism comprising: a slide motion enabling hole disposed in the vane; a slide member to make a slide motion thereof within the slide motion enabling hole; a fit hole disposed in the housing member and into which the slide member is enabled to be fitted; a biasing member to bias the slide member in a direction toward the fit hole; and a hydraulic passage to make the slide motion of the slide member in accordance with a hydraulic pressure applied therethrough;

a linkage pin interposed between a journal of the vane rotor member and the camshaft to prevent a relative rotation between the journal of the vane rotor member and the camshaft, the linkage pin being planted into either one of the journal of the vane rotor member or the camshaft; and a groove into which the linkage pin is inserted formed radially on the other of the journal of the vane rotor member or the cam shaft.

13. A valve open-and-closure timing apparatus for an internal combustion engine as claimed in claim 12, wherein a groove to communicate a portion of the slide motion enabling hole at which the biasing member is placed with an external to the housing member is formed between the boss portion and the housing member.

14. A valve open-and-closure timing changing apparatus for an internal combustion engine, comprising:

a rotary body adapted to revolve in synchronization with a revolution of a crankshaft connected to the engine;

a camshaft;

a housing member that revolves together with the rotary body;

a vane rotor member relatively housed within the housing member, to be revolved together with the camshaft, and having at least one vane radially projected therefrom;

at least one pair of advance angle and retardation angle chambers partitioned between the housing member and vane rotor member by the vane;

hydraulic supply-and-draining device that supplies working oil into either one of the pair of the advance angle or retardation angle chamber while draining the working oil from the other of the pair of the chambers to achieve a relative rotation between the housing member and vane rotor member;

a boss portion projected from one axial direction of the vane rotor member toward an outside of the housing member or extended at same position thereof; and positioning means, movable in a radial direction of one of the camshaft and the vane rotor member, for positioning the vane rotor member and the camshaft to prevent a relative rotation between the vane rotor member and the camshaft.

* * * * *